US005500191A

United States Patent [19]

DeMatte

[11] Patent Number: 5,500,191

[45] Date of Patent: Mar. 19, 1996

[54] PAPER COATING COMPOSITION

[75] Inventor: Michael L. DeMatte, Columbia, Md.

[73] Assignee: Westvaco Corporation, New York, N.Y.

[21] Appl. No.: 380,341

[22] Filed: Feb. 3, 1995

Related U.S. Application Data

[63] Continuation-in-part of Ser. No. 327,475, Oct. 26, 1994, abandoned.

[51] Int. Cl.[6] ..... B05D 3/02; B05D 3/12

[52] U.S. Cl. ..... 427/358; 106/211; 106/214; 427/391

[58] Field of Search ..... 427/361, 365, 427/391, 358; 106/211, 214

[56] References Cited

U.S. PATENT DOCUMENTS

| | | | |
|---|---|---|---|
| 4,012,543 | 3/1977 | Ranger et al. | 427/361 |
| 4,676,836 | 6/1987 | Hill et al. | 106/214 X |

*Primary Examiner*—Michael Lusignan

*Attorney, Agent, or Firm*—Terry B. McDaniell; Daniel B. Reece, IV; Richard L. Schmalz

[57] ABSTRACT

Paper coating formulations comprising sulfated oleic acid as a lubricant additive thereto are disclosed and are characterized by improved healing properties which permit coating at higher solids levels over formulations containing prior art lubricants when applied to the paper with a blade coater.

16 Claims, No Drawings

PAPER COATING COMPOSITION

This application is a continuation-in-part of application Ser. No. 08/327,475, filed Oct. 26, 1994, now abandoned.

BACKGROUND OF THE INVENTION

1. Field of the Invention

The present invention relates to coating papers suitable for printing. More particularly, the present invention relates to an improved coating formulation and application method characterized by improved healing properties. Most particularly, the invention relates to an improved coating formulation comprising, as a lubricant therefor, a sulfated oleic acid.

2. Description of the Prior Art

Coatings are applied to paper stock for the purpose of providing an improved surface finish suitable for printing. High quality coated paper for printing must meet a number of requirements dictated by the nature of the printing process. Thus, the requirements are somewhat different depending on whether the printing is to be done by offset, gravure, or letterpress methods. For example, paper for offset printing generally must have higher moisture resistance than paper for letterpress or gravure printing because the paper is moistened incident to the offset printing process. In general, however, coated printing paper must be smooth and level, dimensionally stable, strong, moisture resistant, resistant to "picking" or pulling up of coating or fibers by contact with a tacky inked surface, and, above all, it must accept ink uniformly without absorbing it excessively. In addition, such properties as opacity, gloss, and color are imparted by the coating: requirements for these vary widely depending on the desired appearance of the finished printed matter but they must be uniform throughout a particular stock.

An uncoated paper surface is not completely smooth but contains higher and lower areas since the thickness of the felted cellulose fibers varies from point to point. The magnitude of these variations in thickness is reduced by the smoothing effect of calendering. However, if the paper is again moistened with water, the cellulose fibers tend to swell and "spring back," increasing the magnitude of the variations. To create a smooth and level printing surface, the coating must fill in all of the low areas of the paper; while, to provide a uniform surface for ink reception, the coating must also cover the fibers in the high areas. When a paper is moistened by application of an aqueous coating, the magnitude of the surface irregularities is increased, and a larger amount of coating must be applied to create a uniform surface.

One commercial method employed to achieve the desired uniform surface is to follow application of the coating to the paper surface with a doctor blade. This application method usually results in even coatings; however, a particular problem with blade coaters is that any deformity in the blade edge can result in scratches in the coating surface. Scratches induced by doctor blades in the coating process are a primary reason for product rejection by quality control, which represents a major manufacturing cost. To an extent, a lubricant additive (such as calcium stearate) in the coating formulation can be employed to assist coating flow properties and will effect some "healing" of the coating surface scratches, thus preserving a uniform surface. The effectiveness of such lubricants, however, is limited by several factors, among which are the % solids in the coating formulation and the severity (i.e., depth and width) of the scratch. A high % solids coating formulation is desired by the manufacturer of coated papers for several reasons.

A high solids content (absent excessive scratching) produces a higher quality coating. Also, a reduction in coating formulation solvent content can reduce production costs significantly, not just in reduced formulation costs but the reduced drying time increases production rate and saves energy costs.

Therefore, an object of this invention is to provide an additive for paper coating formulations which improves the coating's ability to "heal" scratches produced upon application of the coating onto the paper. Another object of the invention is to provide an additive for paper coating formulations which permits the use of coating formulations of higher solids content. Also, an object of the present invention is to provide an additive for paper coating formulations which result in improved paper coatings.

SUMMARY OF THE INVENTION

The above stated objectives are achieved by incorporating in the coating formulation, as a lubricant, a sulfated oleic acid. The sulfated oleic acid containing coating formulation is characterized by improved healing properties and permits coating at higher solids levels over formulations containing prior art lubricants when applied to the paper with blade coaters.

DETAILED DESCRIPTION OF THE PREFERRED EMBODIMENT(S)

Paper and paperboard products primarily coated with mineral pigments and adhesives find their greatest utility for products requiring high print quality. Coatings applied to a paper substrate may account for as much as 15–20% of the total sheet weight. The major coating additives are the various pigments. These pigments improve surface smoothness and uniformity. They also contribute to increased brightness, opacity and gloss for appearance, and to reduced ink showthrough. Major pigments utilized include hydrous kaolin coating clays, fine calcined clay, trihydrated alumina, calcium carbonate, and titanium dioxide.

In order to hold the pigment layer together and bond it to the base sheet surface, various adhesives are utilized. These include starch, casein and lattices. Coating binders affect gloss and ink holdout. The wet rub resistance of the coating layer is also improved by the use of selected adhesives such as butadiene-styrene latex, butadiene-styrene, poly(vinyl acetate) (PVAc), and polyacrylic.

Dispersants promote and maintain the separation of individual pigment particles. This group of additives reduces coating viscosities, enhances coating flow during the application process and contributes to improved coating lay on the base sheet. Typical products utilized include pentasodium tripolyphosphate, tetrasodium pyrophosphate, sodium tetraphosphate, casein, sodium silicate and sodium salts of carboxylic acids. Selection of a dispersant is largely determined by the type of pigments utilized in a specific coating color.

Coating lubricants also improve coating flow properties, coating lay, surface finish and product printability. They reduce the tendency of coating to crack, and they prevent dusting in the paper finishing operation. Typical additives include sodium stearate, calcium stearate, sulfonated oils, and polyethylene emulsions.

Insolubilizers are incorporated in coating colors to improve water resistance. These additives reduce the sensitivity of the adhesives to water and generally improve the wet rub resistance of the coating. Urea resins, such as urea-formaldehyde, melamine resins, such as melamine-formaldehyde, and glyoxal are typical additives used for this end-use requirement.

Viscosity-reducing additives control, lower and stabilize the viscosity of adhesives or pigments in the wet coating prior to application. Typical additives include urea, dicyandiamide, and ethylenediamine. They are important from the standpoint of maintaining uniform flow properties in the coating operation. Viscosity-increasing additives build viscosity into coatings where the primary binder is latex. Additives such as sodium carboxy methylcellulose, which is also an adhesive, increase viscosity to improve runnability, coating lay, and uniformity of deposition. Other such additives include sodium alginate (such as Kelgin) and hydroxy ethylcellulose (HEC).

Paper coatings are generally applied by blade coating or roll coating. Roll coaters usually are not subject to the type of wear in operation which results in the creation of the type scratching of the coating that the invention coating formulation is designed to heal. Nevertheless, the improved flow properties provided by the invention improvements are beneficial to roll coating operations as well.

The invention coating formulations and methods are designed primarily to aid blade coating processes. The blade doctors off excess coating that has been picked up in the applicator pan. The blades usually are tilted toward the incoming web. Typically, blades are thin, only 0.2–0.5 mm thick, and can be rigid or flexible (of spring steel). Blades wear fast and have to be changed relatively often, perhaps 2–4 times a day. Blades are always pressed against the web, which is supported by a backing roll. Wear of the blade results in nicks and other deformatives to the edge contacting the coating which induces visible scratches which, in turn, results in poor coating.

Use of low viscosity formulations to improve the flow properties also results in coatings of reduced quality. In water based coatings, additional drying costs are incurred. The result is increased costs and poorer quality coating.

The present invention coating formulations and methods provide a solution to the scratching problem which avoid increased use of water. The scratch healing benefits of the invention are such that improved coatings are provided economically with higher solids formulations.

Sulfated tall oil fatty acid is known to be used as an additive in paper coating formulations and is believed to promote coating leveling. Several years ago it was surmised that sulfate tall oil fatty acid could be substituted for the calcium stearate additive in a particular commercial formulation. In appreciation of the fact that the sulfated tall oil fatty acid acts as a water-holding agent, it was hypothesized that the additive may allow healing of coating scratches by maintaining coating fluidity. The results of the experiments conducted are shown in Example 1.

EXAMPLE 1

A commercial sulfated tall oil fatty acid (PC-60) sold by Westvaco Corporation was used as a replacement for calcium stearate in bleached board coatings.

The coating formulation control used for evaluations is shown in Table I.

TABLE I

| Ingredients | Parts |
|---|---|
| Pigment | 100 |
| Protein | 2* |
| PVAc | 16* |
| Kelgin MV | 0.103* |
| Ca Stearate | 1.7* |

*Parts/hundred parts pigment

The control formulation exhibited a Brookfield viscosity of 2600 cps, a Hercules 1st Pass of 37, and 2nd Pass of 35.

PC-60 is not particularly compatible with Kelgin and Alcogum thickeners, but it is quite compatible with hydroxyethyl cellulose (HEC, Natrosol) and carboxymethyl cellulose (CMC). Therefore, appropriate substitutions were made in the experimental formulations to account for such incompatibilities. The coatings were based on the standard top coat formulation in Table I, except that coating 2 was thickened with HEC instead of Kelgin and had no lubricant, coating 3 used HEC and calcium stearate (C-104), coating 4 used HEC and PC-60, and coating 5 used PC-60 with a lower than usual amount of Kelgin. The common substrate coated in the tests was a mill-base-coated board produced at Westvaco's Covington, Va. bleached board mill.

The coatings were applied using a benchtop coater in pond-blade mode with the minimum loading required for runnability. The coater was run at 30 feet per minute with hot air drying. The time from the blade to drying was about two second (as compared to ~0.5 second on a paper machine). The coating scratch was induced by means of a pin placed immediately after the blade. Photomicrographs of the scratches were made at a magnification of 64 diameters. The widths of the scratches were measured.

The relative coating scratch widths are shown in Table II.

TABLE II

| Coating/ Formulation | No. Scratches | Min.* | Max.* | Mean* | Std. Error | Std. Dev. |
|---|---|---|---|---|---|---|
| 1 (control) | 12 | 23 | 47 | 38.3 | 2.3 | 7.6 |
| 2 (HEC) | 12 | 31 | 55 | 39.7 | 2.7 | 8.9 |
| 3 (C-104) | 12 | 23 | 39 | 33.2 | 1.4 | 4.8 |
| 4 (PC-60) | 12 | 23 | 47 | 33.9 | 2.0 | 6.8 |
| 5 (Kelgin) | 12 | 31 | 47 | 34.3 | 1.8 | 6.1 |

*in micrometers

There was no significant difference between the scratch widths of coating formulations 3 and 4 (33.2 μm and 33.9 μm, respectively, 20% significance level). The low level of significance leads to the conclusion that PC-60 yielded no improvement in scratch healing propensity.

EXAMPLE 2

For reasons unrelated to scratch heal tendency, an alternative commercial paper coating formulation lubricant was developed by sulfating oleic acid (WVSR). Inasmuch as tall oil fatty acid is comprised of 47–52% oleic acid, there was no reason to suspect that the sulfated oleic acid would perform any differently as a scratch healer than the sulfated tall oil fatty acid lubricant. Nevertheless, tests were performed as in Example 1 with different results.

An experiment was conducted on a laboratory blade coater wherein scratching was induced by running the standard top coat coating at solids higher than normal. Coating solids content was increased from the normal 58% to 63%. Two top coat formulations, (1) the standard top coat formulation (a high synthetic binder, polyvinyl acetate, formulation with no starch binder) containing calcium stearate (Nopcote $C_{104}$) and (2) the same formulation except with WVSR substituted for the $C_{104}$ were compared. The coatings were applied at blade loads from 6 to 30 pli with each blade load applied for 30 seconds. All coatings were applied to 10 point bleached board produced on the same paper machine at Westvaco's Covington, Va. mill. The board was base coated on the same paper machine with Covington's blade coater. The scratching data are reported in Tables III and IV.

TABLE III

| | $C_{104}$ | |
|---|---|---|
| Blade Pressure (PLI) | Coating Weight (lbs/ream) | Scratches |
| 6 | 25.8 | 20 |
| 10 | 12.9 | 19 |
| 15 | 9.9 | 14 |
| 20 | 7.8 | 50–60 |
| 25 | 5.1 | ~150 |
| 30 | 2.1 | 9, many fine scratches |

TABLE IV

| | WVSR | |
|---|---|---|
| Blade Pressure (PLI) | Coating Weight (lbs/ream) | Scratches |
| 6 | 19.9 | 0 |
| 10 | 9.5 | 1 |
| 15 | 7.4 | 1 |
| 20 | 5.7 | 1 |
| 25 | 4.0 | 9 |
| 30 | 1.6 | Many fine scratches |

(The $C_{104}$ coating was 63.2% solids, 4080 cps Brookfield viscosity and 64.6 cps Hercules high shear viscosity. The WVSR coating was 63.0% solids, 4000 cps Brookfield viscosity and 55.6 cps Hercules viscosity. The sequence of blade pressure application 15, 20, 25, 30, 6, and 10 pli. Some scratches at low pressures may be residual from higher blade pressure.)

The number of scratches that were visible across the eleven inch wide coated, gloss calendered paperboard were counted. As can be seen in Tables III and IV, the control calcium stearate coating produced a large number of scratches even at the lowest blade load. The WVSR coating produced scratching only at higher blade pressures and at these pressures significantly less scratches were observed compared to the calcium stearate containing coating. In view of the similarity of the scratch healing properties of the PC-60 and calcium stearate formulations reported in Example 1, the dramatically different scratch healing properties of the calcium stearate and WVSR formulations reported in this Example 2 were surprising and unexpected.

The lower high shear viscosity for coatings containing the sulfated oleic acid could be advantageous not only in reducing coating scratching but also may have potential to improve print quality. Print quality often can be improved by increasing coating solids. This is because, at higher coating solids, less coating and binder strikes into the board result in a more uniform, continuous coating layer. Since the normal limitation on coating solids is coating scratches, the lower high shear viscosity may allow higher coating solids to be pan on the blade coater.

It is to be understood that, while the present invention has been described by reference to preferred embodiments, other variations and equivalents thereof may suggest themselves to those skilled in the art without departing from the spirit and scope of the invention as described by the claims appended hereto.

What is claimed is:

1. An improved paper coating formulation comprising an effective amount of a scratch-healing additive and one or more additives selected from the group consisting of mineral pigments, adhesives, dispersants, lubricants, insolubilizers, viscosity-reducing additives, and viscosity-increasing additives, wherein the improvement comprises coating formulations characterized by a solids content greater than 60% and, as the scratch-healing additive, sulfated oleic acid.

2. The improved paper coating formulation of claim 1 wherein the viscosity-increasing additives are selected from the group consisting of sodium alginate, sodium carboxy methylcellulose, and hydroxy ethylcellulose.

3. The improved paper coating formulation of claim 1 wherein the mineral pigments are selected from the group consisting of coating clay, fine calcined clay, trihydrated alumina, calcium carbonate, and titanium dioxide.

4. The improved paper coating formulation of claim 1 wherein the adhesives are selected from the group consisting of starch, casein, latex, poly(vinyl alcohol), sodium carboxy methylcellulose, and hydroxy ethylcellulose.

5. The improved paper coating formulation of claim 1 wherein the dispersants are selected from the group consisting of tetrasodium pyrophosphate, pentasodium tripolyphosphate, sodium tetraphosphate, sodium silicate, casein, and sodium salts of carboxylic acid.

6. The improved paper coating formulation of claim 1 wherein the lubricants are selected from the group consisting of sodium stearate, calcium stearate, sulfonated oils, sulfated tall oil fatty acid, and polyethylene emulsions.

7. The improved paper coating formulation of claim 1 wherein the insolubilizers are selected from the group consisting of urea resins, melamine resins, glyoxal, zinc compounds, formaldehyde, and dimethylol urea.

8. The improved paper coating formulation of claim 1 wherein the viscosity-reducing additives are selected from the group consisting of urea, dicyandiamide, and ethylenadiamine.

9. An improved method of applying a coating formulation comprising an effective amount of a scratch-healing additive and one or more additives selected from the group consisting of mineral pigments, adhesives, dispersants, lubricants, insolubilizers, viscosity-reducing additives, and viscosity-increasing additives onto paper employing blade applicators wherein the improvement comprises a coating formulation characterized by a solids content greater than 60% and, as the scratch-healing additive, sulfated oleic acid.

10. The improved method of claim 9 wherein the mineral pigments are selected from the group consisting of coating clay, fine calcined clay, trihydrated alumina, calcium carbonate, and titanium dioxide.

11. The improved method of claim 9 wherein the adhesives are selected from the group consisting of starch, casein, latex, poly(vinyl alcohol), sodium carboxy methylcellulose, and hydroxy ethylcellulose.

12. The improved method of claim 9 wherein the dispersants are selected from the group consisting of tetrasodium pyrophosphate, pentasodium tripolyphosphate, sodium tetraphosphate, sodium silicate, casein, and sodium salts of carboxylic acid.

13. The improved method of claim 9 wherein the lubricants are selected from the group consisting of sodium stearate, calcium stearate, sulfonated oils, sulfated tall oil fatty acid, and polyethylene emulsions.

14. The improved method of claim 9 wherein the the insolubilizers are selected from the group consisting of urea resins, melamine resins, glyoxal, zinc compounds, formaldehyde, and dimethylol urea.

15. The improved method of claim 9 wherein the viscosity-reducing additives are selected from the group consisting of urea, dicyandiamide, and ethylenadiamine.

16. The improved method of claim 9 wherein the viscosity-increasing additives are selected from the group consisting of sodium alginate, sodium carboxy methylcellulose, and hydroxy ethylcellulose.

* * * * *